US012320227B2

(12) United States Patent
Kalwar et al.

(10) Patent No.: US 12,320,227 B2
(45) Date of Patent: Jun. 3, 2025

(54) MONITORING INTEGRITY OF DOWNHOLE MECHANICAL PLUG

(71) Applicant: Saudi Arabian Oil Company, Dhahran (SA)

(72) Inventors: Ghulam Murtaza Kalwar, Udhailiyah (SA); Abdullah A Mulhim, Udhailiyah (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/318,989

(22) Filed: May 17, 2023

(65) Prior Publication Data

US 2024/0384621 A1 Nov. 21, 2024

(51) Int. Cl.

| | |
|---|---|
| ***E21B 47/11*** | (2012.01) |
| ***E21B 33/124*** | (2006.01) |
| ***E21B 33/129*** | (2006.01) |
| ***E21B 47/117*** | (2012.01) |

(52) U.S. Cl.
CPC ..... *E21B 33/124* (2013.01); *E21B 33/129* (2013.01); *E21B 47/11* (2020.05); *E21B 47/117* (2020.05)

(58) Field of Classification Search
CPC ..... E21B 47/11; E21B 47/117
See application file for complete search history.

(56) References Cited

U.S. PATENT DOCUMENTS

| | | | |
|---|---|---|---|
| 6,659,175 | B2 | 12/2003 | Malone et al. |
| 7,560,690 | B2 | 7/2009 | Stray et al. |
| 8,322,414 | B2 | 12/2012 | Al-Gouhi et al. |
| 9,133,683 | B2 | 9/2015 | Dyer et al. |
| 9,910,026 | B2 | 5/2018 | Zhang et al. |
| 10,655,456 | B2 * | 5/2020 | Espe ..... E21B 47/07 |

(Continued)

FOREIGN PATENT DOCUMENTS

| | | |
|---|---|---|
| WO | WO 2012054496 | 4/2012 |
| WO | WO 2014104914 | 4/2014 |
| WO | WO 2017155412 | 9/2017 |

OTHER PUBLICATIONS

Anopov et al., "Permanent Downhold Chemical Tracer System for Wireless Surveillance and Optimizing Well Production," presented at the SPE/IADC Middle East Drilling Technology Conference and Exhibition, Abu Dhabi, UAE, Jan. 29-31, 2018, 13 pages.

(Continued)

*Primary Examiner* — Catherine Loikith
(74) *Attorney, Agent, or Firm* — Fish & Richardson P.C.

(57) ABSTRACT

To monitor integrity of downhole mechanical plug, a plug is deployed to a target position in a wellbore. The plug is set at the target position to provide a seal between the plug and an internal surface of a wellbore wall. The seal isolates the wellbore uphole of the plug from downhole of the plug. The plug includes a perforated carrier having a tracer system within. Fluid in the wellbore downhole of the plug is allowed to flow through holes of the perforated carrier to contact the tracer system thereby releasing the tracer into the fluid. Fluid produced uphole of the plug is flowed to the Earth surface. A sample of the produced fluid is collected and analyzed for presence of tracer in the sample. By doing so, integrity of the plug is evaluated.

10 Claims, 4 Drawing Sheets

(56) References Cited

U.S. PATENT DOCUMENTS

2016/0209391 A1 7/2016 Zhang et al.
2019/0323342 A1* 10/2019 Pedersen ..... E21B 21/065

OTHER PUBLICATIONS

Semikin et al., "Autonomous ICD Well Performance Completed With Intelligent Inflow Tracer Technology in the Yuri Korchagin Field in Russia," presented at the SPE Russian Petroleum Technology Conference, Moscow, Russia, Oct. 26-28, 2015, 21 pages.

* cited by examiner

100

300

400

MONITORING INTEGRITY OF DOWNHOLE MECHANICAL PLUG

TECHNICAL FIELD

This disclosure relates to isolating a portion of a wellbore with a mechanical plug.

BACKGROUND

Mechanical plugs may be utilized to isolate a portion of a wellbore in a subterranean formation, such as with a wellbore configured to produce hydrocarbon from the subterranean formation. The hydrocarbon may be crude oil or natural gas. Water can generally undesirably be produced along with the hydrocarbon. A mechanical plug may also be called a bridge plug.

SUMMARY

An aspect relates to a method of applying and monitoring a mechanical isolation plug in a wellbore, including deploying a plug that is a mechanical isolation plug to a target position in a wellbore, wherein the wellbore is formed through the Earth surface into a subterranean formation in the Earth crust; setting the plug at the target position, thereby providing a seal between the plug and an internal surface of a wellbore wall of the wellbore, wherein the seal isolates in the wellbore downhole of the plug from uphole of the plug, wherein the plug has a perforated carrier having a tracer system in an inside volume of the perforated carrier, and wherein the tracer system has a tracer in a solid medium; allowing fluid in the wellbore downhole of the plug to flow through holes of the perforated carrier to contact the tracer system, thereby releasing the tracer from the solid medium into the fluid; flowing produced fluid produced uphole of the plug through the wellbore to the Earth surface; collecting a sample of the produced fluid at the Earth surface and performing analysis of the sample for detecting presence of the tracer in the sample; and evaluating integrity of the mechanical isolation plug based on the analysis.

Another aspect relates to a mechanical isolation plug including a body having mechanical slips to engage a surface of a wall of a wellbore to set the mechanical isolation plug in the wellbore and a sealing element to engage the wall of the wellbore to seal downhole of the mechanical isolation plug from uphole of the mechanical isolation plug; a perforated carrier coupled to the body and configured to be situated in the wellbore downhole of the sealing element, the perforated carrier having holes to allow wellbore fluid downhole of the mechanical isolation plug to flow into an inside volume of the perforated carrier; and a tracer system disposed in the inside volume of the perforated carrier, the tracer system having a tracer in a solid medium, wherein the solid medium is configured to release the tracer into the wellbore fluid during contact of the solid medium with the wellbore fluid.

The details of one or more implementations are set forth in the accompanying drawings and the description below. Other features and advantages will be apparent from the description and drawings, and from the claims.

BRIEF DESCRIPTION OF DRAWINGS

Like reference numbers and designations in the various drawings indicate like elements.

DETAILED DESCRIPTION

Figure 1:
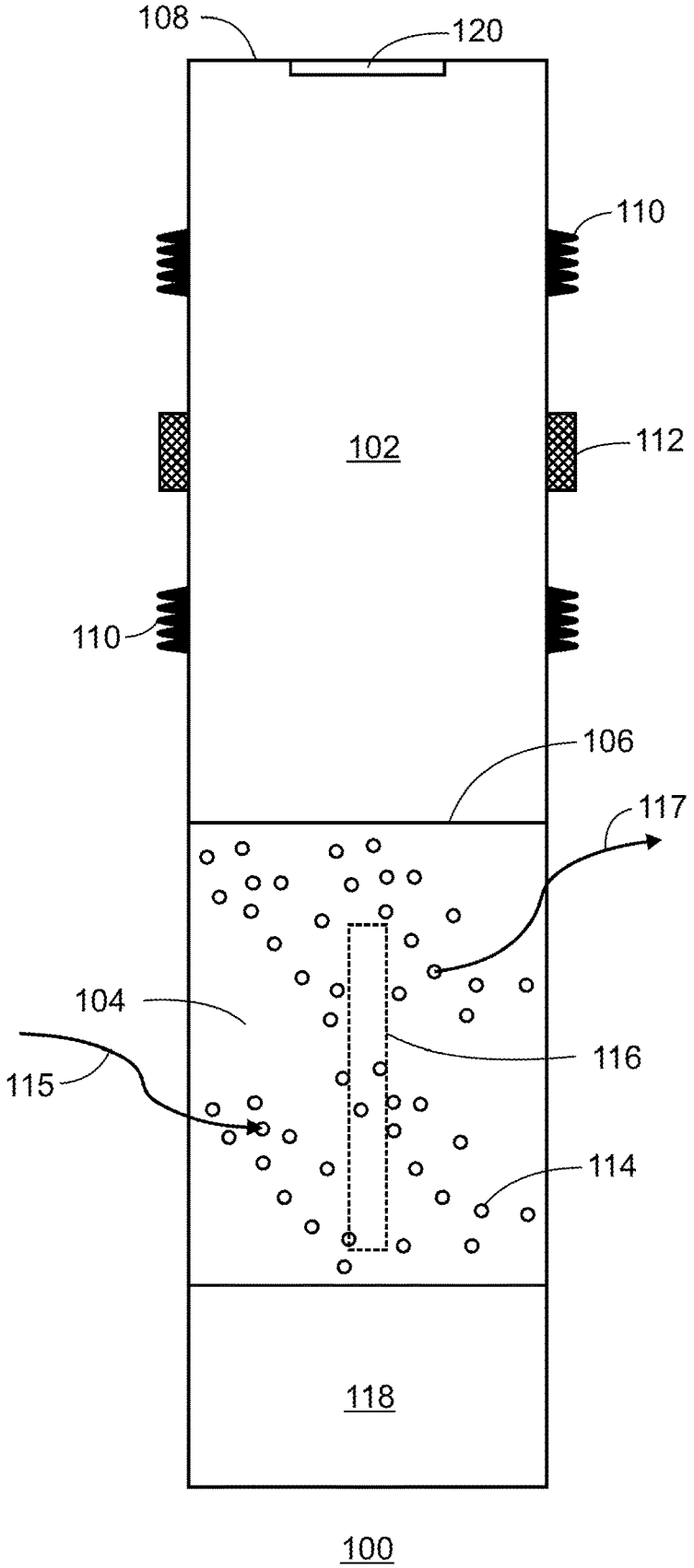
FIG. 1 is a diagram of a mechanical isolation plug having a perforated carrier with tracer system.

Some aspects of the present disclosure are directed to a mechanical isolation plug(s) having a tracer system(s) (soluble tracers embedded in a solid medium) in a bottom portion (downhole portion) of the plug(s). The mechanical isolation plugs each include a perforated carrier (e.g., a conduit or housing) on the downhole end portion of the sealing element of the plug. The solid medium having the soluble tracer(s) may be situated inside the carrier. When condensate or water contacts the tracer system, the tracer is released and will be produced to the surface if the plug leaks. Fluid samples are collected at surface and analyzed in the laboratory for the presence of the specific tracer. If the particular tracer is detected in the produced fluid, then the conclusion is the relevant plug is leaking (the integrity of the plug is failing). If the tracer is not detected in the produced fluid, then the conclusion can be that the plug is not leaking (the integrity of the plug is satisfied).

In accordance with present embodiments, the technique is directed to monitoring integrity of mechanical isolation plugs set in a wellbore. The monitoring can be monitoring of the seal in the wellbore provided by the mechanical isolation plug. The seal can be between the mechanical isolation plug and the wellbore wall. Downhole of the plug is sealed from uphole of the plug. The wellbore to one distal end of the plug may be isolated from the wellbore to the other distal end of the plug. The monitoring of the mechanical plug integrity can be via the aforementioned tracer system.

The mechanical isolation plug as set (installed) having integrity may mean that the isolation plug interfaces with the wellbore casing to seal (isolate) a downhole portion of the wellbore from an uphole portion of the wellbore without fluid leaking across the isolation plug between downhole and uphole. Embodiments herein may provide for long term monitoring, such as for years (e.g., 2-6 years), the integrity or sealing (or the seal) of the mechanical isolation plug(s) to confirm that fluid is not leaking across the plug. The monitoring can be without well intervention, such as the typical costly well intervention conventionally implemented to check mechanical isolation plugs set in a wellbore. Again, the mechanical isolation plug(s) has the tracer to accommodate the monitoring.

As indicated, samples of produced fluid can be collected at the surface (e.g., at or near the wellhead) to determine if fluid is leaking across the mechanical isolation plug. The sampled produced fluid can be analyzed to detect presence of the tracer in the produced fluid. The mechanical isolation plug having the tracer downhole of the plug sealing element (s) can provide, for example, to determine if unwanted produced fluid is from the previous zone below (downhole of) the plug instead of from the current producing zone above (uphole of) the plug.

Multiple mechanical isolation plugs (each having a unique tracer system) may be employed in the wellbore. Therefore, the monitoring may involve monitoring multiple mechanical isolation plugs in the wellbore contemporaneously or simultaneously. In these implementations, the multiple plugs can have a different (distinguishable) tracer compound, respectively.

Mechanical plugs are generally set downhole in the wells at desired depths for isolating the unwanted zones or suspending wells for long term. Objectives for deploying and setting the mechanical plug can be, for example, [1] abandoning the zone post reservoir depletion or after water breakthrough, [2] isolating unwanted zones of the wellbore, such as during drilling, production, or injection cycle of the well, or [3] temporary suspending the well till further intervention or abandonment is confirmed, and the like. In some cases, cement is dumped above the plug and that plug is treated as permanent isolation technique. After setting mechanical plugs in the wellbore, the mechanical plugs are generally pressure tested and their integrity confirmed.

A pressure test may involve bleeding off the pressure from the tubing above the mechanical plug (bridge plug) to a differential not exceeding plug design limits. Then, monitor pressure buildup for a period, for example, of 10-30 minutes, to confirm that the bridge plug is holding pressure from below. A second pressure test may involve applying pressure in the tubing using compatible fluid to a pressure value below the plug pressure differential limit set by manufacturer as well as below burst limits of completion jewelry if any or exposed tubing/casings over the initial wellhead pressure before bleeding down if applicable. This may confirm that the bridge plug is holding pressure above.

In some applications, the mechanical plug cannot be tested post setting due to the presence of perforated interval above the mechanical plug. Mechanical plugs may remain downhole for several years and in cases conventionally, the mechanical plugs be assumed to holding (sealing) as per design specifications.

Bottoms up completion and production strategy in cased hole (cased wellbore) completions may be implemented where an underlying or bottom (e.g., bottom most) reservoir layer is perforated/produced and then post depletion (or if unwanted fluid breakthrough) that layer (zone) is isolated utilizing a mechanical plug followed by perforating and producing next upper interval (zone). The mechanical plugs may remain in the wellbore for months or years. After producing this new zone for some time, if the well starts producing unwanted fluids, an issue may be to identify whether that fluid is entering from the current producing zone or the previous zone due to plug leak. In order to identify the source of the fluid, costly well intervention is typically implemented conventionally for performing extensive diagnostics. If there is restricted wellbore accessibility, then that option may not be viable.

Mechanical isolation plugs may also be deployed and set in the wells as barriers for temporarily suspending the well until further well intervention is performed or the well is abandoned. If mechanical plugs remain downhole for an extended period (e.g., 6 months to 6 years), there is possibility of its leak due to downhole pressure, temperature, or wellbore fluids conditions over the mechanical plug. If the conventional mechanical plug leaks and such is not timely identified in wells where the mechanical plug is utilized as a barrier, then well integrity problems can be encountered.

As discussed, embodiments of the present techniques provide a mechanical isolation plug having tracers (soluble in wellbore fluid) and a technique (e.g., with no well intervention) to monitor integrity of the mechanical plug set downhole (including for several years, such as 2-6 years). The mechanical isolation plug has the tracer embedded in a solid medium installed in a pre-perforated carrier of the mechanical isolation plug. The carrier (e.g., perforated conduit) of the mechanical isolation plug can be, for example, threaded or welded to the main body or mandrel of the mechanical isolation plug. The carrier may be coupled to a bottom portion (downhole portion) of the plug body so to be downhole of the plug sealing element(s) when the mechanical isolation plug is deployed and set. When wellbore fluid downhole of the plug, such as water or hydrocarbon (e.g., condensate, crude oil, etc.) contacts the tracer, a tracer (e.g., unique tracer) may be released gradually with time. The tracer may thus be produced at surface if the mechanical isolation plug leaks. Fluid samples can be collected at surface and analyzed in the laboratory for presence of unique chemical tracers in the produced fluid, which can confirm the integrity (or lack thereof) of the mechanical isolation plug.

FIG. 1 is a mechanical isolation plug 100 having a main body 102 (e.g., a mandrel) coupled to a perforated carrier 104. The main body 102 is coupled to the perforated carrier 104 at the depicted interface 106 of the main body 102 with the perforated carrier 104. The main body 102 coupled to the perforated carrier 104 can be, for example, the perforated carrier 104 threaded or welded to the main body 102 at the interface 106. The top or uphole end of the mechanical isolation plug 100 is indicated by reference numeral 108. Thus, the perforated carrier 104 is coupled to bottom (downhole) end or bottom (downhole) portion of the main body 102.

The body 102 includes mechanical slips 110 and a sealing element 112 disposed along the body 102. The body 102 may include the mechanical slips 110 to engage a surface of a wall of a wellbore to set the mechanical isolation plug in the wellbore. The body 102 may include the sealing element 112 to engage the wall of the wellbore to seal downhole of the mechanical isolation plug 100 from uphole of the mechanical isolation plug 100 in the wellbore. The setting of the plug 100 via the mechanical slips 110 along with engagement of the sealing element 112 with the wellbore wall can provide a seal between the plug 100 and an internal surface of a wellbore wall, wherein the seal isolates in the wellbore downhole of the plug 100 from uphole of the plug 100.

The mechanical slips 110 can be wedge-shaped or other shape, and can have protrusions (for example, on the slip face) such as teeth, buttons, wickers, inserts, wedges, and the like, to engage (for example, grip) the wall of a wellbore, such as an inside surface of casing, tubing, or liner. The mechanical slips 110 are typically radially expandable or extendable to engage (abut, grip, partially penetrate, or hook into) the wall of the wellbore (the wall of the wellbore casing) to secure (lock, fix, or anchor) the mechanical isolation plug 102 in place in the wellbore. The mechanical slips 110 may longitudinally fix the mechanical isolation plug 102 in place in the wellbore. The seal or sealing element 112 may be sealing elements that are packer type to prevent flow upward or downward. The sealing element 112 may be or include elastomer, rubber, metal, donut-shaped, seal assembly, rings, metallic rings, backup rings, lock, ratchet-lock, anchor, packing, packer seal, and so on. In operation, the sealing element 112 may be radially expanded against the wellbore wall (e.g., against an inner surface of the wellbore casing) to seal the mechanical isolation plug 102 as set in place.

The body 102 with the mechanical slips 110 and the sealing element 112 can be a conventional mechanical isolation plug adapted as a portion of the present mechanical isolation plug 100. Moreover, a mechanical isolation plug can be known as a bridge plug. As indicated, a mechanical isolation plug (or bridge plug) may facilitate the lower wellbore to be sealed (e.g., permanently sealed) from production, or isolated (e.g., temporarily isolated) from a treatment conducted on an upper zone.

In the illustrated embodiment, the perforated carrier 104 is generally cylindrical, and can be a conduit, a tubing, a pipe, and the like. In one example, the perforated carrier 104 may be similar to a pup joint. The perforated carrier 104 can be a perforated carrier 104 conduit.

The perforated carrier 104 is below the sealing element 112, for toward downhole. The perforated carrier 104 has perforations or holes 114 (in the conduit wall of the perforated carrier 104) to allow wellbore fluid to enter to the inside volume of the perforated carrier 104. The inlet flow arrow 115 is representative of wellbore fluid flowing (entering) through perforations 114 into the hollow perforated carrier 104 for contact of the wellbore fluid with the tracer system 116 inside the hollow perforated carrier 104. The tracer system 116 is shown as dashed to indicate the tracer system 116 is disposed in the inside volume of the perforated carrier 104. The outlet flow arrow 117 is representative of wellbore fluid flowing (exiting) through perforations 114 from inside the hollow perforated carrier 104 to in the wellbore external of the carrier 104 This wellbore fluid that exits the carrier 104 may have a tracer released from the tracer system 116. For the mechanical isolation plug 100 set in a wellbore, the wellbore fluid entering the inside volume of the perforated carrier 104 may be wellbore fluid in the isolated portion of the wellbore below the sealing element 112. Thus, the mechanical isolation plug 100 includes the perforated carrier 104 coupled to the body 102 and configured to be situated in the wellbore downhole of the sealing element 112, and with the perforated carrier 104 having holes 114 to allow wellbore fluid downhole of the mechanical isolation plug 100 to flow into the inside volume of the perforated carrier 104.

The tracer system 116 (chemical tracer system) is disposed in the inside volume of the perforated carrier 104. The tracer system 116 includes a tracer in a solid medium. The tracer may be embedded in a solid medium. The solid medium (e.g., polymer or resin) is configured to release the tracer into the wellbore fluid during contact of the solid medium with the wellbore fluid. In implementations, the solid medium includes a controlled-release resin configured to provide a controlled release (gradual release over time) of the tracer into the wellbore fluid during contact of the solid medium with the wellbore fluid. In implementations, the solid medium is attached to an inside surface of the perforated carrier conduit in the inside volume. The tracer can be soluble in water. In other implementations, the tracer can be soluble in hydrocarbon, such as condensate or crude oil.

Again, the mechanical isolation plug 100 may include the perforated carrier 104 having a tracer system 116 in an inside volume of the perforated carrier 104, and wherein the tracer system 116 includes a tracer (e.g., embedded) in a solid medium. A technique of applying and monitoring the mechanical isolation plug 100 may include allowing fluid in the wellbore downhole of the plug 100 to flow through the holes 114 of the perforated carrier 104 to contact the tracer system 116, thereby releasing (e.g., diffusing) the tracer from the solid medium into the fluid. The technique may include flowing produced fluid produced uphole of the plug 100 through the wellbore to the Earth surface, collecting a sample of the produced fluid at the Earth surface and performing analysis of the sample for detecting presence of the tracer in the sample, and evaluating integrity of the mechanical isolation plug based on the analysis, as discussed.

The tracer system 116 may be a commercially available tracer system, such as those available from Raman AS having headquarters in Trondheim, Norway. See, for example, U.S. Pat. No. 7,560,690, which is incorporated herein by reference. The tracer may consist of a chemical compound in the applied environment that is combined with a solid medium (e.g., polymer formulations) giving a polymer matrix having the tracer (e.g., embedded therein). In one example, the tracer system 116 resembles strips of plastic. The solid medium may be attached (e.g., cemented or otherwise adhered) to the inside surface (inside diameter) of the perforated carrier 104 conduit wall. The solid medium as polymer may be, for example, melamine formaldehyde resin, phenol-formaldehyde resin, melamine-phenol-formaldehyde resin, furan-formaldehyde resin, epoxy, and polymers suitable at downhole temperatures, and so on.

The mechanical isolation plug 100 may include a cap or bull plug 118. The mechanical isolation plug 100 may include the bull plug 118 to prevent the tracer system 116 dislodging from inside the perforated carrier 116 to outside the mechanical plug 100. As depicted, the bull plug 118 may be coupled (e.g., threaded) to a distal end of the perforated carrier 104 conduit opposite the distal end (at interface 106) of the perforated carrier 104 connected to the body 102. The mechanical isolation plug 100 may have a coupling element 120 (e.g., fish neck) at the top 108 or top portion of the plug 100 for setting and retrieving the plug 100. The coupling element 120 may couple or engage with the deployment extension 316 of FIG. 3.

In implementations, after isolating a wellbore or wellbore zone with the mechanical isolation plug, the plug may remain in the wellbore for several years. Over time, if unwanted fluids start producing from that well, then may be difficult conventionally to identify whether that fluid is flowing through the mechanical isolation plug or from another source. Historically, well intervention is implemented to diagnose whether unwanted fluids are being produced from the isolated zone through a leaking mechanical plug or any other source. Conversely, embodiments herein provide for intervention-less monitoring of integrity of (any fluid leaking across) the mechanical isolation plug via the mechanical isolation plug having a tracer system, and with the technique analyzing the produced fluid at surface for presence of the tracer. Applications in which mechanical plug integrity can be monitored via embodiments herein for several years may include, for example, [1] after performing water shutoff and producing from intervals (zones) that are not isolated, [2] Immediately or soon after setting the mechanical isolation plug when set below an existing perforated interval and in which thus the mechanical isolation plug cannot be pressure tested, [3] mechanical isolation plugs set in the wellbore for suspending the well until abandonment, and so on.

As mentioned, the present mechanical isolation plug has in its perforated carrier a tracer system (e.g., as tracer strips) that is a solid medium having the tracer. When water, condensate, or crude oil contacts the tracer/solid medium, the particular tracer is released gradually. The mechanical isolation plug leak can be detected by collecting fluid samples at surface and analyzing for the presence of unique chemical tracers in the laboratory.

Condensate (natural-gas condensates that are hydrocarbons) may be the liquid form of these hydrocarbons that take their name from the process of removing them from the gas stream by processing with specific temperature and pressure. In instances, the terms natural gas liquids (NGL) and condensate can generally be used interchangeably. NGLs and condensates may both be a mixed stream of hydrocarbons representing light hydrocarbons, such as ethane, and heavier hydrocarbons, such as pentane.

Figure 2:
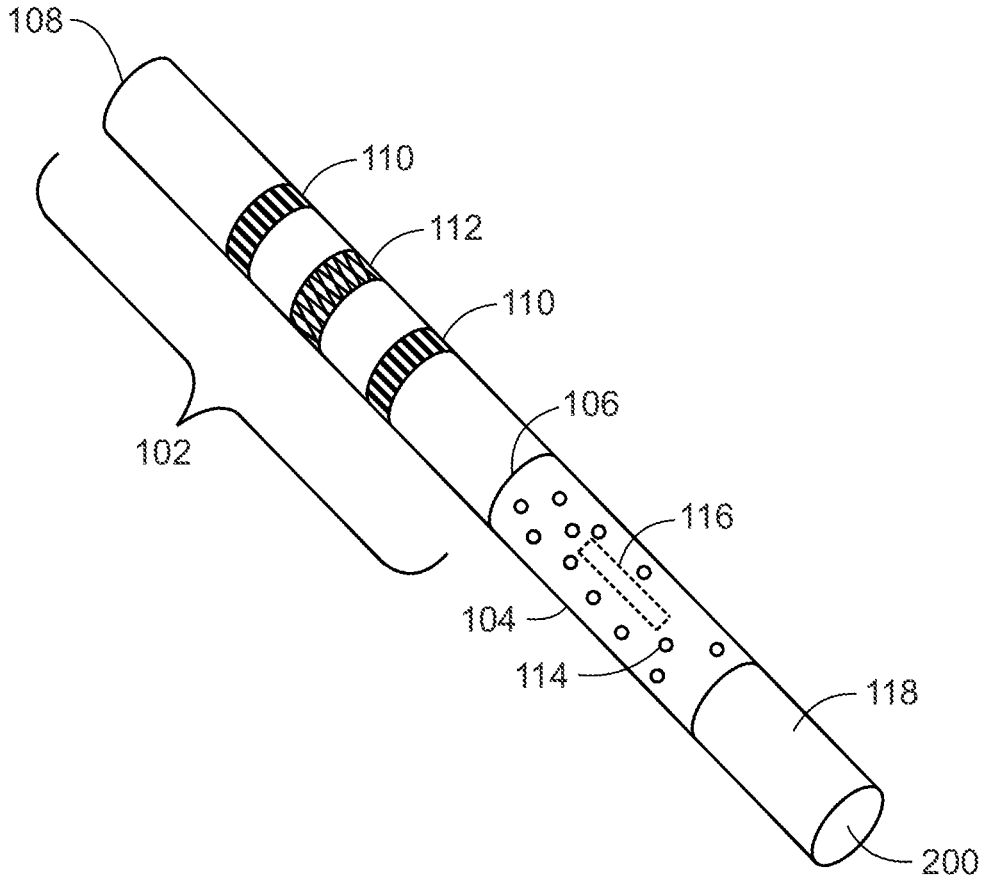
FIG. 2 is a perspective view diagram of the mechanical isolation plug of FIG. 1.

FIG. 2 is a perspective view representation of the mechanical isolation plug 100 of FIG. 1. The main body 102 (e.g., mandrel) has the mechanical slips 110 and the sealing element 112, as with a conventional mechanical plug (or bridge plug). When the mechanical isolation plug is deployed to the target position in the wellbore, to activate or set the mechanical isolation plug 100 (e.g., extend the slips 110 and expand the sealing element 112 against the wellbore casing) may be by activating a setting tool, waiting (e.g., at least 5 minutes) after the setting tool has fired, and then pick up and run back in the hole and set the setting tool on the mechanical plug or bridge plug to ensure that the plug is in place and has not slipped downhole. In the activation/setting, the sealing element 112 (e.g., packer elements or seal) and the mechanical slips 110 may engage the wellbore casing and thus provide a seal. Such setting can be hydraulic, mechanical, and/or electrical/signal initiated, and may be, for example, via a wireline or work string, and the like. In one example, the mechanical isolation plug 100 may be activated or set, for example, by dropping a setting ball that lands on a ball seat in the body 102, and then applying pressure (e.g., via a surface pump).

The perforated carrier 104 of the mechanical isolation plug 100 is connected (e.g., threaded and/or welded) to the body 102 at the interface 106 of the perforated carrier 104 with the body 102. As discussed, the perforated carrier includes the tracer system 116 inside the carrier 104. The perforated carrier 104 has holes 114 that allow fluid to enter the carrier 104 and contact the tracer system 116.

As also discussed, the mechanical isolation plug 100 may optionally include a cap or bull plug 118. The end 200 of the bull plug 118 may be closed. Indeed, a bull plug 118 may generally be solid (not hollow).

The uphole end 108 of the mechanical isolation plug 100 may be labeled as the top end of the mechanical isolation plug 100. While the mechanical isolation plug 100 may be deployed in wellbore vertical portions, wellbore deviated portions, and wellbore horizontal portions (lateral), the end 108 may be characterized as the top end of the plug 100 to be situated toward uphole when the plug 100 is installed in the wellbore. The perforated carrier 104 (and the bull plug 118 if employed) is at the bottom portion of the plug 100, which will be the downhole portion of the plug 100 when the plug 100 is installed.

The configuration of the mechanical plug 100 can be applied to a cement retainer. The cement retainer can be equipped with the perforated carrier 104 having the holes 114 and the tracer system 116, and with the perforated carrier 104 below the sealing element of the cement retainer. Thus, the techniques discussed above with respect to monitoring integrity of the present mechanical isolation plug can be applied to the modified cement retainer to monitor sealing integrity of the cement retainer as configured to have the perforated carrier and the tracer system.

Figure 3:
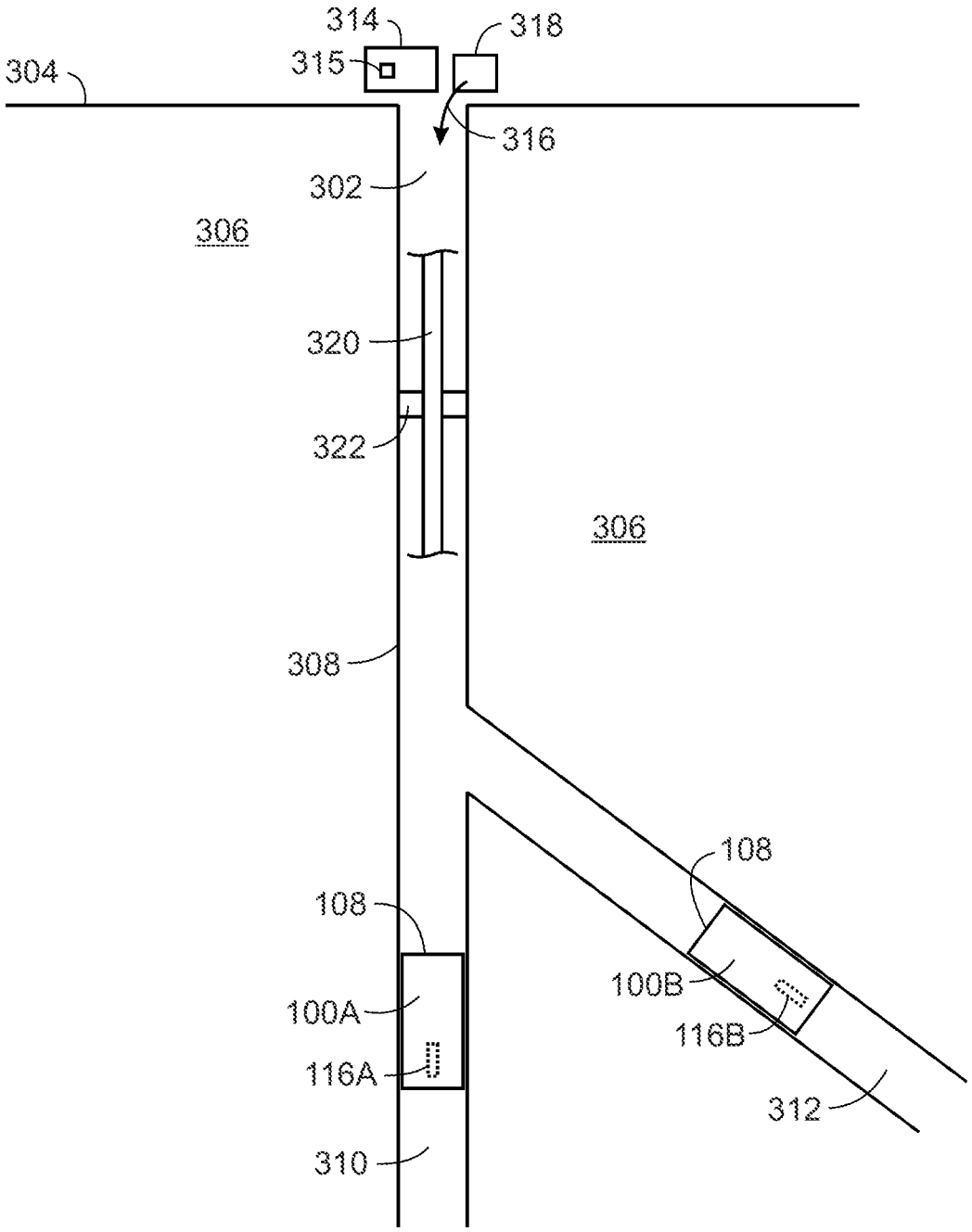
FIG. 3 is a diagram of a well site having a wellbore.

FIG. 3 is a well site 300 having a wellbore 302 formed through the Earth surface 304 into a subterranean formation 306 in the Earth crust. In this example, the wellbore 302 is generally a cased wellbore. Therefore, the wellbore wall 308 is casing. There may be cement between the casing and the formation 306 face at the wellbore 302. In implementations, the casing and cement may have perforations to allow for production of hydrocarbon (and water) from the subterranean formation 306 through the casing/cement perforations into the wellbore 302 to the Earth surface 304. The casing/cement perforations may also allow for injection of fluid from the Earth surface through the wellbore 302 into the formation 306, such as when the wellbore 302 is operated in an injection cycle.

A first mechanical isolation plug 100A is installed and set in a vertical portion of the wellbore 302. A second mechanical isolation plug 100B is installed and set in a deviated lateral portion of the wellbore 302. The mechanical isolation plugs 100A, 100B may be the same as or analogous to the mechanical isolation plug 100 of FIGS. 1 and 2. The mechanical slips of each mechanical isolation plug 100A, 100B may be engaged with the wellbore wall 308 to set the mechanical isolation plugs 100A, 100B. The sealing element(s) of each mechanical isolation plug 100A, 100B may be engaged with the wellbore wall 308 to provide a respective seal in the wellbore 302.

The top end 108 of each mechanical isolation plug 100A, 100B faces uphole toward the Earth surface 304. The first mechanical isolation plug 100A, via its sealing element and seal with the wellbore wall 308, isolates (seals) the downhole vertical portion 310 of the wellbore 302 from uphole of the first mechanical isolation plug 100A. The second mechanical isolation plug 100B, via its sealing element and seal with the wellbore wall 308, isolates (seals) the downhole lateral portion 312 of the wellbore 302 from uphole of the second mechanical isolation plug 100B.

The perforated carrier of the first mechanical isolation plug 100A is below (downhole of) the sealing element of the first plug 100A and has a first tracer system 116A in an inside volume of the perforated carrier. Similarly, the perforated carrier of the second mechanical isolation plug 100B is below (downhole of) the sealing element of the second plug 100B and has a second tracer system 116B in an inside volume of the perforated carrier.

The first tracer system 116A includes a first tracer in a solid medium. The second tracer system 116B includes a second tracer in a solid medium. The first tracer is different from the second tracer. The first tracer and the second tracer may each be unique with respect to the wellbore environment and fluid. The tracer systems 116A, 116B (chemical tracer systems) may each include a unique tracer (first tracer and second tracer) embedded in the solid medium (e.g., porous polymer material), respectively, and thus facilitate monitoring of integrity of the mechanical isolation plugs 100A and 100B without downhole well intervention. A downhole well intervention as conventionally performed to evaluate integrity (e.g., whether the seal is leaking or not) of a mechanical isolation plug may involve running a production logging tool (PLT) or noise log till top of the plug conveyed on slickline, wire line or coil tubing. If there is some space available between top of plug and perforation interval or any inflow zone then PLT can be run till near the top of plug which may determine if there is any fluid passing through plug seal by detecting through its spinner and sensors. Another option may be running noise log till top of the plug which may detect any unexpected noise related to fluid movement across the plug.

The tracer systems 116A, 116B may have a chemical affinity to either hydrocarbon or water. When fluid comes into contact with the tracer systems 116A, 116B, the respective tracer molecules (first tracer and second tracer) diffuse from the solid medium into the fluid. The tracers may be soluble in water or soluble in hydrocarbon (e.g., condensate, crude oil, etc.), depending on the application. If no significant water production is experienced or expected, then tracers that are hydrocarbon soluble may employed. On the other hand, if the isolated zone is a water zone or water is being produced, water-soluble tracers may be employed. In certain more complex scenarios, the first tracer can include a tracer that is hydrocarbon soluble and another tracer that is water soluble, and the second tracer can include a tracer that is hydrocarbon soluble and another tracer that is water soluble.

As discussed, samples of produced fluid may be intermittently collected at surface 304 (e.g., manually collected by a human operator at or near the wellhead 314) for analysis (e.g., in a laboratory) of presence of the tracer. If the first tracer is detected, that indicates the integrity of the first mechanical isolation plug 100A is not satisfied (is failing or failed) in that the first plug 100A seal is leaking. If the second tracer is detected, that indicates the integrity of the second mechanical isolation plug 100B is not satisfied (is failing or failed) in that the second plug 100B seal is leaking.

The sampling point 315 for collecting liquid samples of the produced fluid for tracer analysis can be along a flow line of the wellhead 314 (Christmas tree). The sampling point 315 can be downstream of the wellhead 314. Other configurations are applicable.

More than two of the present mechanical isolation packers can be installed in a wellbore. Moreover, in cases in which cement is added (dumped) on top of the first mechanical isolation plug 100A and/or the second mechanical isolation plug 100B, the present monitoring of integrity of the mechanical isolation plugs 100A, 100B may nevertheless be beneficial, as the cement may degrade and thus allow for fluid leaks from downhole. A scenario is both the mechanical isolation plug failing (leaking) and the cement uphole (on top) of the mechanical isolation plug failing at the same time or contemporaneously. If the longitudinal length of the cement plug above the mechanical isolation plug is relatively short, then the cement may deteriorate with time due to well conditions.

Initially, to deploy (lower into the wellbore 302) the first mechanical isolation plug 100A and the second mechanical isolation plug 100B, a deployment extension 316 from a dispenser 318 may lower the plugs 100A, 100 B, respectively, into the wellbore 302. Other configurations are applicable. In some implementations, the deployment extension 316 is coiled tubing and the dispenser 318 is a coiled tubing reel. In other implementations, the deployment extension 316 is a wireline and the dispenser 318 is a wireline truck. The deployment extension 316 may be a conduit, cable, slickline, work string, drill string, or jointed pipe.

In implementations, the wellbore 302 above the plugs 100A, 100B may be completed with completion string including production tubing 320, production packers(s) 322, etc. As mentioned, the casing and cement at the wellbore wall 308 may have perforations to allow for production of hydrocarbon (and water) from the subterranean formation 306. Wellbore zone(s) above the mechanical isolation plugs 100A, 100B may be a producing zone.

Figure 4:
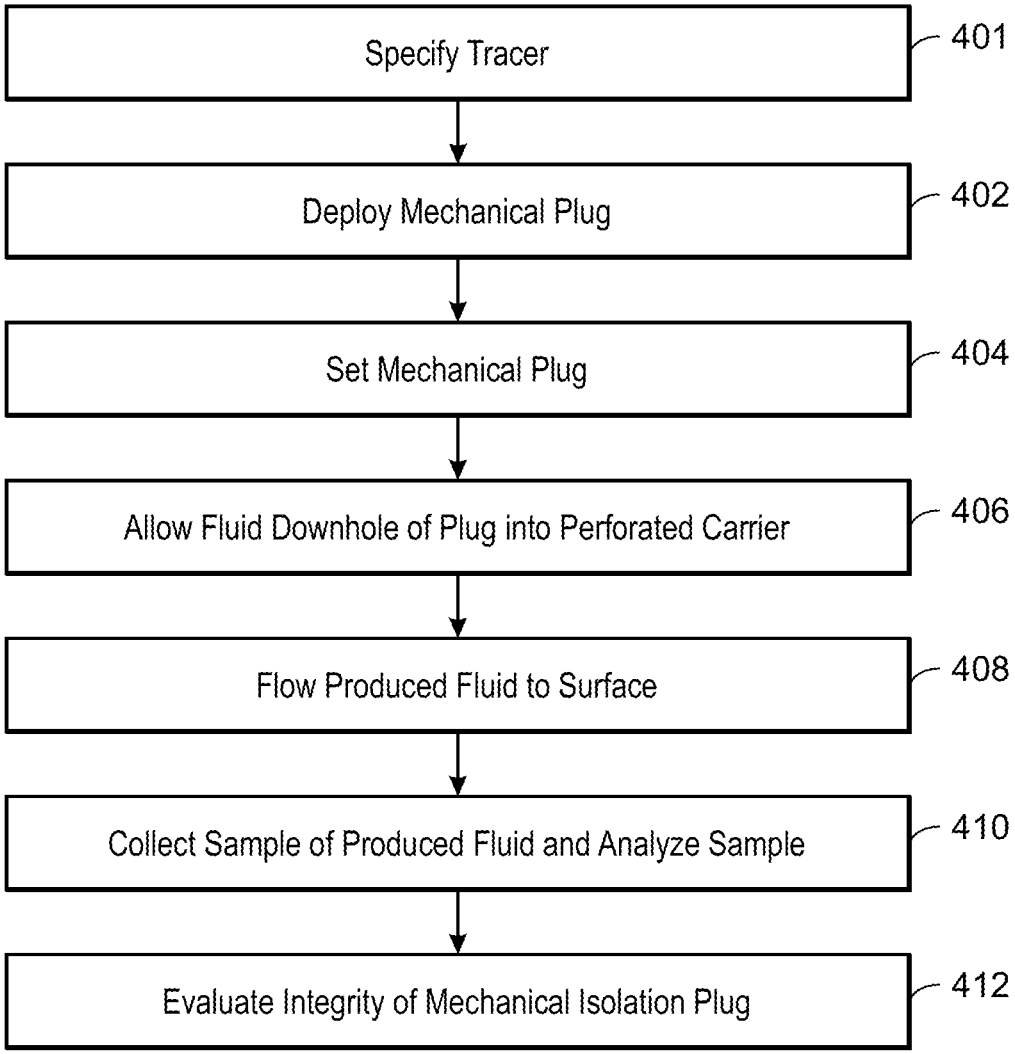
FIG. 4 is a block flow diagram of a method of applying and monitoring a mechanical isolation plug in a wellbore.

FIG. 4 is a method 400 of applying and monitoring a mechanical isolation plug in a wellbore. The wellbore is formed through the Earth surface into a subterranean formation in the Earth crust.

At block 401, the method includes selecting or specifying the tracer of the tracer system installed (or to be installed) in the perforated carrier of the mechanical isolation plug. As discussed, the tracer system may be a solid having an embedded tracer. The specifying of a selected tracer may be in response to the type(s) [e.g., condensate, oil, water, etc.] of wellbore fluid in the isolated portion of the wellbore below the mechanical isolation plug when installed in the wellbore. The tracer selected may be a tracer that is soluble in the wellbore fluid below the mechanical isolation plug. For instance, if the wellbore fluid downhole of the target positon (target depth) of the mechanical isolation plug includes condensate, the tracer may be selected/specified as soluble in condensate or hydrocarbon generally. If the wellbore fluid downhole of the target positon (target depth) of the mechanical isolation plug includes significant amount of water, the tracer may be selected/specified as soluble in water. The tracer selected may be a tracer as a chemical (component, compound, molecule, etc.) that is unique in the wellbore environment so to be uniquely identifiable. The tracer selected may be a tracer as a chemical (component, compound, molecule, etc.) that is different than other tracers in the wellbore, such as tracers in other tracer systems in perforated carriers of other mechanical isolation plugs in the wellbore, so that the tracer can be uniquely identified and not confused with other tracers.

At block 402, the method includes deploying the mechanical isolation plug to a target position in the wellbore. The deploying includes lowering the mechanical isolation plug from the Earth surface into the wellbore. The target position may be a specified depth in the wellbore.

At block 404, the method includes setting the mechanical isolation plug at the target position, thereby providing a seal between the mechanical isolation plug and an internal surface of a wellbore wall of the wellbore. The seal isolates in the wellbore downhole of the plug from uphole of the plug.

The plug includes a perforated carrier having a tracer system in an inside volume of the perforated carrier. The tracer system includes a tracer in a solid medium, such as embedded in the solid medium. The solid medium may be, for example, polymer, such as porous polymer or polymer matrix. The polymer can be resin.

At block 406, the method includes allowing fluid in the wellbore downhole of the mechanical isolation plug to flow through holes of the perforated carrier to contact the tracer system, thereby releasing the tracer from the solid medium into the fluid. The releasing of the tracer may involve diffusing of the tracer from the solid medium into the fluid due to (caused by) contact of the fluid with the solid medium.

At block 408, the method includes flowing produced fluid produced uphole of the mechanical isolation plug through the wellbore to the Earth surface. In implementations, the mechanical isolation plug is set below (downhole of) a perforated interval of the wellbore.

At block 410, the method includes collecting a sample of the produced fluid at the Earth surface and performing analysis of the sample for detecting presence of the tracer in the sample. The analytical equipment (instrument) to perform the analysis may depend on the chemical tracer, including the tracer molecule(s), structure of the chemical tracer, etc. The analytical equipment (instrument) to perform the analysis may include, for example, spectroscopy, liquid chromatography, and so on.

At block 412, the method includes evaluating integrity of the mechanical isolation plug based on the analysis. The evaluating of the integrity may involve determining the integrity of the mechanical isolation plug as satisfied in response to the analysis not detecting the presence of the tracer in the sample. The evaluating of the integrity may involve determining the integrity of the mechanical isolation plug as not satisfied in response to the analysis detecting the presence of the tracer in the sample.

In implementations, a well intervention (downhole well intervention) of the wellbore is not performed to evaluate and determine integrity of the mechanical isolation plug. In implementations, a device other than the mechanical isolation plug is not deployed in the wellbore to evaluate and determine integrity of the mechanical isolation plug. In implementations, a pressure test is not performed to evaluate the integrity of the mechanical isolation plug.

The mechanical isolation plug may be a first mechanical isolation plug, and the method may include deploying a second mechanical isolation plug to a second target position in the wellbore. The second plug includes a second perforated carrier having a second tracer system including a second solid medium having a second tracer. The second tracer is different from the tracer in the tracer system of the first plug. In this implementation, the method includes setting the second plug at the second target position, thereby providing a second seal between the second plug and the wellbore wall, wherein the second seal isolates in the wellbore downhole of the second plug from uphole of the second plug. The method may include evaluating integrity of the second mechanical isolation plug based on the analysis of the sample, wherein the analysis includes analysis for detecting presence of the second tracer in the sample.

An embodiment is a mechanical isolation plug including a body having mechanical slips to engage a surface of a wall of a wellbore to set the mechanical isolation plug in the wellbore and a sealing element to engage the wall of the wellbore to seal downhole of the mechanical isolation plug from uphole of the mechanical isolation plug; a perforated carrier coupled (e.g., threaded or welded) to the body and configured to be situated in the wellbore downhole of the sealing element, the perforated carrier (e.g., a perforated carrier conduit) having holes to allow wellbore fluid (e.g., water or hydrocarbon, or both) downhole of the mechanical isolation plug to flow into an inside volume of the perforated carrier; and a tracer system disposed in the inside volume of the perforated carrier, the tracer system including a tracer in (e.g., embedded in) a solid medium, wherein the solid medium (e.g., polymer or resin) is configured to release the tracer into the wellbore fluid during contact of the solid medium with the wellbore fluid. The tracer may be soluble in the wellbore fluid. In implementations, the solid medium includes a controlled-release resin configured to provide a controlled release of the tracer into the wellbore fluid during contact of the solid medium with the wellbore fluid. In implementations, the solid medium is attached to an inside surface of the perforated carrier conduit in the inside volume. In implementations, the mechanical isolation plug includes a bull plug or cap coupled to a first distal end of the perforated carrier conduit, wherein the perforated carrier is coupled to the body at a second distal end of the perforated carrier conduit opposite the first distal end.

Embodiments provide a technique without downhole well intervention to monitor integrity of the mechanical isolation plugs set in the wellbore. As discussed, the mechanical isolation plug includes a tracer system in bottom (downhole) portion below the sealing element of the mechanical plug. The technique may involve identifying objectives and requirements for setting the mechanical plug in the wellbore. Objectives may include, for example, abandoning a wellbore zone post reservoir depletion or water breakthrough, isolating an unwanted wellbore zone or wellbore during drilling, production or injection cycle of the well, or suspending the wells till further intervention or abandonment is confirmed. Requirements may include, for example, specifications (e.g., design specifications) of the plug and tracer suited for the wellbore environment and that meets the objectives. The technique may include considering or evaluating well performance and requirements to determine if setting a mechanical plug in the well (wellbore) is a viable option, and then record current well parameters for comparison with post plug/tracer system installation. The project or method may include select a beneficial or applicable tracer for the particular fluid (wellbore fluid, produce fluid) that may flow to the surface if the mechanical isolation plug leaks. The tracers have chemical attraction to either oil or water. When oil or water contacts with the tracer, the respective tracer molecules diffuse into the well and flows to surface if the plug starts leaking. Other tasks may include to interpret cement evaluation logs (if available), check cement quality behind casing, and analyze the tubing and casing integrity by evaluating corrosion logs (if available), annuli pressures history, and annuli fluids sampling if applicable. Petrophysical logs can be interpreted, and the mechanical plug setting depth selected.

To implement the present mechanical isolation plug may include shut-in the well, rig-up slickline, and pressure test pressure control equipment and lubricator, run fullbore size gauge cutter drift considering minimum inside diameter (ID) of the completion string and maximum outside diameter (OD) of the plug for wellbore accessibility confirmation, rig down slickline, rig up wireline and pressure test Pressure Control Equipment (PCE) and lubricator. The method can include placing tracer strips (select a commercially successful solid tracer system) inside the pre-perforated carrier (size smaller than minimum ID of the completion string) of the mechanical isolation plug and secure bottom end of the mechanical isolation plug with the bull plug if desired. The technique can include to make-up plug setting tool, correlation log, and plug assembly with the wireline, and then pick-up plug BHA and pull into lubricator, pressure test lubricator and BOP to the desired limit. Then, run plug to the target depth and set the plug after correlating the setting depth with correlation logs if applicable, pull out of hole (POOH) to surface and confirm plug setting, rig down wireline equipment, pressure test plug to the desired pressures (positive and negative if applicable) to confirm plug integrity, and monitor well performance over the life of the well. If well performance is affected and it suspected that unwanted fluids are being produced, then start collecting the liquid samples at surface. The liquid samples may be collected at or near the wellhead prior to the separation of fluids at surface so to reduce or avoid misrepresentation of the tracer signal by the transport path towards sampling point. Analyze the collected samples for presence of the unique tracer particles. If tracer elements are identified then it is confirmed that plug is leaking and isolated zone is contributing.

A number of implementations have been described. Nevertheless, it will be understood that various modifications may be made without departing from the spirit and scope of the disclosure.

What is claimed is:

1. A method of applying and monitoring a mechanical isolation plug in a wellbore, comprising:

deploying a plug that is a mechanical isolation plug to a target position in a wellbore, wherein the wellbore is formed through Earth surface into a subterranean formation in Earth crust;

setting the plug at the target position, thereby providing a seal between the plug and an internal surface of a wellbore wall of the wellbore, wherein the seal isolates in the wellbore downhole of the plug from uphole of the plug, wherein the plug comprises a perforated carrier having a tracer system in an inside volume of the perforated carrier, and wherein the tracer system comprises a tracer in a solid medium;

allowing fluid in the wellbore downhole of the plug to flow through holes of the perforated carrier to contact the tracer system, thereby releasing the tracer from the solid medium into the fluid;

flowing produced fluid produced uphole of the plug through the wellbore to the Earth surface;

collecting a sample of the produced fluid at the Earth surface and performing analysis of the sample for detecting presence of the tracer in the sample; and evaluating integrity of the mechanical isolation plug based on the analysis.

2. The method of claim 1, wherein evaluating the integrity comprises determining the integrity of the mechanical isolation plug as satisfied in response to the analysis not detecting the presence of the tracer in the sample.

3. The method of claim 1, wherein evaluating the integrity comprises determining the integrity of the mechanical isolation plug as not satisfied in response to the analysis detecting the presence of the tracer in the sample.

4. The method of claim 1, wherein the target position comprises a specified depth in the wellbore.

5. The method of claim 1, wherein a well intervention of the wellbore is not performed to evaluate and determine integrity of the mechanical isolation plug.

6. The method of claim 1, wherein a device other than the mechanical isolation plug is not deployed in the wellbore to evaluate and determine integrity of the mechanical isolation plug.

7. The method of claim 1, wherein the mechanical isolation plug is set downhole of a perforated interval of the wellbore.

8. The method of claim 1, wherein a pressure test is not performed to evaluate the integrity of the mechanical isolation plug.

9. The method of claim 1, wherein the plug is a first plug, and wherein the method comprises:

deploying a second plug that is a second mechanical isolation plug to a second target position in the wellbore, wherein the second plug comprises a second perforated carrier having a second tracer system comprising a second solid medium having a second tracer, wherein the second tracer is different than the tracer in the tracer system of the first plug; and setting the second plug at the second target position, thereby providing a second seal between the second plug and the wellbore wall, wherein the second seal isolates in the wellbore downhole of the second plug from uphole of the second plug.

10. The method of claim 9, comprising evaluating integrity of the second plug based on the analysis of the sample, wherein the analysis comprises analysis for detecting presence of the second tracer in the sample.

* * * * *